US012442577B2

(12) United States Patent
Chang

(10) Patent No.: US 12,442,577 B2
(45) Date of Patent: Oct. 14, 2025

(54) SNOWFLAKE MACHINE

(71) Applicant: NOVACORP INC., Guangzhou (CN)

(72) Inventor: Ming-Cheng Chang, Tainan (TW)

(73) Assignee: NOVACORP INC., Guangzhou (CN)

( * ) Notice: Subject to any disclaimer, the term of this patent is extended or adjusted under 35 U.S.C. 154(b) by 142 days.

(21) Appl. No.: 18/508,858

(22) Filed: Nov. 14, 2023

(65) Prior Publication Data

US 2024/0219094 A1 Jul. 4, 2024

(30) Foreign Application Priority Data

Dec. 29, 2022 (TW) ..... 111150740
Dec. 29, 2022 (TW) ..... 111214542

(51) Int. Cl.
*F25C 3/00* (2006.01)
*A63J 5/02* (2006.01)

(52) U.S. Cl.
CPC ..... *F25C 3/00* (2013.01); *A63J 5/028* (2013.01); *F25C 2303/046* (2013.01)

(58) Field of Classification Search
CPC ..... F25C 3/00; F25C 3/04; F25C 2303/046; A63J 5/028
See application file for complete search history.

(56) References Cited

U.S. PATENT DOCUMENTS 3,829,013 A * 8/1974 Ratnik ..... F25C 3/04 239/431
2012/0286059 A1* 11/2012 Willett ..... A63J 5/028 239/14.2

FOREIGN PATENT DOCUMENTS

EP 3162423 A1 * 5/2017 ..... A63J 5/028
GB 2558082 A * 7/2018 ..... A63J 5/028

* cited by examiner

*Primary Examiner* — Joseph F Trpisovsky
(74) *Attorney, Agent, or Firm* — Che-Yang Chen; Law Office of Michael Chen

(57) ABSTRACT

A snowflake machine (10) comprises a blower (84) and an outlet device (72) is connected to the blower (84). The outlet device (72) includes a primary passageway (80) and a secondary passageway (82) around the primary passageway (80). The blower (84) operates to generate air currents which drives bubbles to pass through the primary passageway (80), thereby pushing the bubbles into the air. Air currents passing through the secondary passageway (82) to push the bubbles farther away from the outlet device (72).

12 Claims, 7 Drawing Sheets

SNOWFLAKE MACHINE

BACKGROUND OF THE INVENTION

The present invention relates to a snowflake machine and, more particularly, to a snowflake machine which simulates snowfall by providing tiny bubbles drifting downward from the sky.

A snowflake machine currently available on the market can generate tiny white bubbles which can be blown upward into the sky by air currents from a blower. Then, the tiny bubbles drift downward to simulate a visual effect of snowfall. Such a snowflake machine have several disadvantages in use. One of the disadvantages is that the tiny white bubbles have certain stickiness and, thus, tend to stick to and accumulate on the nozzle of the snowflake machine. The bubbles stick to/accumulated on the nozzle may return to the liquid state after a period of time or the amount of the bubbles is too much, leading to dripping at the nozzle of the conventional snowflake machine.

Furthermore, due to the characteristics of the bubbles per se, the snowflake machine is incapable of using the air currents to push the bubbles to a position distant to the snowflake machine, such that the snowfall simulating effect may be unsatisfactory. Furthermore, the snowflake machine often generate large noises when it is required to push the bubbles farther.

BRIEF SUMMARY OF THE INVENTION

In an aspect, the present invention provides a snowflake machine comprising:

a base;

a blower fixed in the base and including an air outlet;

an outlet device connected to the blower, wherein the outlet device includes a primary passageway and a secondary passageway spaced from the primary passageway, and wherein each of the primary passageway and the secondary passageway intercommunicates with the air outlet of the blower;

a bubble forming cap disposed in the primary passageway and intercommunicating with the air outlet;

a storage tank securely disposed in the base and configured to store a bubble liquid; and a pump securely disposed in the base, wherein the pump delivers the bubble liquid to the bubble forming cap, wherein the blower operates to generate air currents to cause the bubble forming cap to generate bubbles, wherein the air currents generated by the blower pass through the primary passageway and the secondary passageway and move to an outer side of the outlet device, thereby pushing the bubbles generated by the bubble forming cap outward, and wherein the air currents pass through the secondary passageway to prevent the bubbles and the bubble liquid from accumulating in an outlet of the primary passageway and to push the bubbles farther away from the outlet device.

The air currents flowing out of the primary passageway push the bubbles away from the snowflake machine, and the air currents flowing out of the secondary passageway are around the bubbles. Thus, the air currents from the secondary passageway can maintain the bubbles within a certain distance in the air. As a result, the bubbles pushed into the air will not disperse and fall in a place near the snowflake machine. Accordingly, the bubbles simulating snowfall can be pushed to a place farther from the snowflake machine.

In an example, the outlet device further includes a first portion and a second portion disposed around the first portion. The primary passageway is inside the first portion. The secondary passageway is formed between the first portion and the second portion. The primary passageway includes a first end permitting ejection of the air currents and the bubbles and a second end permitting entrance of the air currents. The secondary passageway includes an outlet end aligned with the first end of the primary passageway. The first portion further includes a plurality of cutouts adjacent to the first end of the primary passageway and spaced from the second end of the primary passageway. Each of the plurality of cutouts intercommunicates with the first end of the primary passageway and the outlet end of the secondary passageway.

By the provision of the plurality of cutouts, the primary passageway and the secondary passageway can intercommunicate with each other, such that the air currents from the primary passageway and the air currents from the secondary passageway interact with each other. Thus, the bubbles are less likely to accumulate on the outlet device.

In an example, the primary passageway includes a first end remote from the blower and a second end adjacent to the blower. The secondary passageway includes an outlet end adjacent to the first end of the primary passageway and an inlet end adjacent to the second end of the primary passageway. A cross sectional area of the outlet end is greater than a cross sectional area of the first end, such that a velocity of air currents flowing through the outlet end is smaller than a velocity of air currents flowing through the first end.

The cross sectional area of the first end is smaller than that of the outlet end, such that the pressure of the air currents flowing through the first end is smaller than that of the pressure of the air currents flowing through the outlet end. As a result, a sucking force can be generated at the first end relative to the outlet end. Thus, the bubbles accumulated at the first end of the outlet device can be easily pushed toward the primary passageway due to the pressure difference and subsequently pushed into the air by the air currents from the primary passageway. Accordingly, water dripping at the outlet device resulting from accumulation of bubbles is less likely to occur.

In an example, the cross sectional area of the first end of the primary passageway is smaller than a cross sectional area of the second end of the primary passageway. A cross sectional area of the inlet end is smaller than a cross sectional area of the outlet end. The secondary passageway further includes an intermediate portion between the outlet end and the inlet end. A cross sectional area of the intermediate portion is smaller than the cross sectional area of the inlet end, such that high-frequency noises generated by the air currents flowing through the secondary passageway is reduced.

In an example, the snowflake machine further comprises:

a first casing including an inner air passageway and an outer air passageway around the inner air passageway, wherein the first casing further includes a chamber intercommunicating with the inner air passageway and the outer air passageway, wherein the primary passageway and the secondary passageway intercommunicate with the outer air passageway, and wherein the bubble forming cap is connected to and intercommunicates with the inner air passageway; and a second casing coupled with the first casing, wherein the second casing includes an inner space and a plurality of slots intercommunicating the inner space with an outer side of the second casing, wherein the inner spaced is spaced from the chamber, wherein the blower is received in the chamber and the inner space, wherein the blower includes an air inlet located in the inner space, wherein the air outlet of the blower is located in the chamber, and wherein each of the plurality of slots is located between the air inlet and the air outlet in a lateral direction.

In an example, the snowflake machine further comprises:

an inner muffler securely disposed in the chamber of the first casing and spacedly disposed around the air outlet, wherein the inner muffler is configured to reduce sounds resulting from operation of the blower and flow of the air currents; and an outer muffler, wherein the second casing further includes an inner peripheral wall and an outer peripheral wall spaced from and around the inner peripheral wall, wherein the inner space is defined by the inner peripheral wall, wherein an outer space is defined between the inner peripheral wall and the outer peripheral wall, wherein the outer space extends to an outer side of the second casing, wherein the plurality of slots is formed on the inner peripheral wall and intercommunicates with the inner space and the outer space, and wherein the outer muffler abuts the outer side of the second casing and is configured to reduce sound resulting from operation of the blower for sucking in air.

The inner muffler is used to absorb sounds resulting from operation of the blower and the outputted air currents. The outer muffler is used to effectively absorb the sounds resulting from the air currents sucked into the blower and operation of the blower, such that the overall noise value caused by the operation of the whole snowflake machine is further reduced. By the disposition of the outer space and the inner space of the second casing, the sound resulting from the airflow during the air-sucking operation of the blower can be reduced.

In another aspect, the present invention provides a snowflake machine comprising:

a base;

a first casing securely disposed on the base, wherein the first casing includes a chamber, an inner air passageway intercommunicating with the chamber, and an outer air passageway located around the inner air passageway and intercommunicating with the chamber;

a second casing securely disposed on the base, wherein the second casing includes an outer side and an inner side, wherein the second casing further includes an inner space extending from the inner side toward but spaced from the outer side, wherein the second casing further includes a plurality of slots intercommunicating with the inner space, and wherein the inner side of the second casing is sealingly coupled with the first casing;

a blower securely disposed between the first casing and the second casing, wherein the blower includes an air inlet located in the inner space and an air outlet located in the chamber;

an inner muffler securely disposed in the chamber and spaced from the blower, wherein the inner muffler reduces sound resulting from operation of the blower and air currents flowing out of the air outlet;

an outer muffler permitting passage of air and abutting the outer side of the second casing, wherein the outer muffler reduces sound resulting from the air currents sucked into the air inlet of the blower;

a bubble forming cap coupled with the inner air passageway of the first casing;

an outlet device coupled with the outer air passageway of the first casing, wherein the outlet device includes a primary passageway intercommunicating with the outer air passageway, and wherein the bubble forming cap is located in the primary passageway;

a storage tank securely disposed in the base and configured to store a bubble liquid; and a pump securely disposed in the base, wherein the pump delivers the bubble liquid to the bubble forming cap, wherein the blower operates to generate air currents to cause the bubble forming cap to generate bubbles, wherein the air currents generated by the blower further pass through the primary passageway and move to an outer side of the outlet device, thereby pushing the bubbles generated by the bubble forming cap outward.

The inner muffler is used to absorb sounds resulting from operation of the blower and the outputted air currents. The outer muffler is used to effectively absorb the sounds resulting from the air currents sucked into the blower and operation of the blower, such that the overall noise value caused by the operation of the whole snowflake machine is further reduced.

In an example, the second casing further includes an inner peripheral wall extending to the inner side and an outer peripheral wall spaced from and around the inner peripheral wall. The inner space is defined by the inner peripheral wall. An outer space is defined between the inner peripheral wall and the outer peripheral wall. The outer space extends to the outer side of the second casing. The plurality of slots is formed on the inner peripheral wall and intercommunicates with the inner space and the outer space. The outer muffler is configured to permit air currents to flow into and cover the inner space.

By the disposition of the outer space and the inner space of the second casing, the sound resulting from the airflow during the air-sucking operation of the blower can be reduced.

In an example, the outer muffler further includes a sinuous face abutting the outer side of the second casing. The outer side and the sinuous face have gaps therebetween to permit entrance of the air currents into the outer space.

In an example, the outlet device further includes a first portion and a second portion disposed around the first portion. The primary passageway is inside the first portion. The secondary passageway is formed between the first portion and the second portion. The first portion further includes a plurality of cutouts formed at an outlet of the primary passageway. Each of the plurality of cutouts intercommunicates with the primary passageway and the secondary passageway.

By the provision of the plurality of cutouts, the primary passageway and the secondary passageway can intercommunicate with each other, such that the air currents from the primary passageway and the air currents from the secondary passageway interact with each other. Thus, the bubbles are less likely to accumulate on the outlet device.

In an example, the primary passageway includes a first end remote from the air outlet of the blower and a second end adjacent to the air outlet of the blower. The secondary passageway includes an outlet end adjacent to the first end of the primary passageway and an inlet end adjacent to the second end of the primary passageway. A cross sectional area of the first end is smaller than a cross sectional area of the outlet end, such that a velocity of air currents flowing through the first end is greater than a velocity of air currents flowing through the outlet end.

The cross sectional area of the first end is smaller than that of the outlet end, such that the pressure of the air currents flowing through the first end is smaller than that of the pressure of the air currents flowing through the outlet end. As a result, a sucking force can be generated at the first end relative to the outlet end. Thus, the bubbles accumulated at the first end of the outlet device can be easily pushed toward the primary passageway due to the pressure difference and subsequently pushed into the air by the air currents from the primary passageway. Accordingly, water dripping at the outlet device resulting from accumulation of bubbles is less likely to occur.

The present invention will become clearer in light of the following detailed description of illustrative embodiments of this invention described in connection with the drawings.

Figure 1:
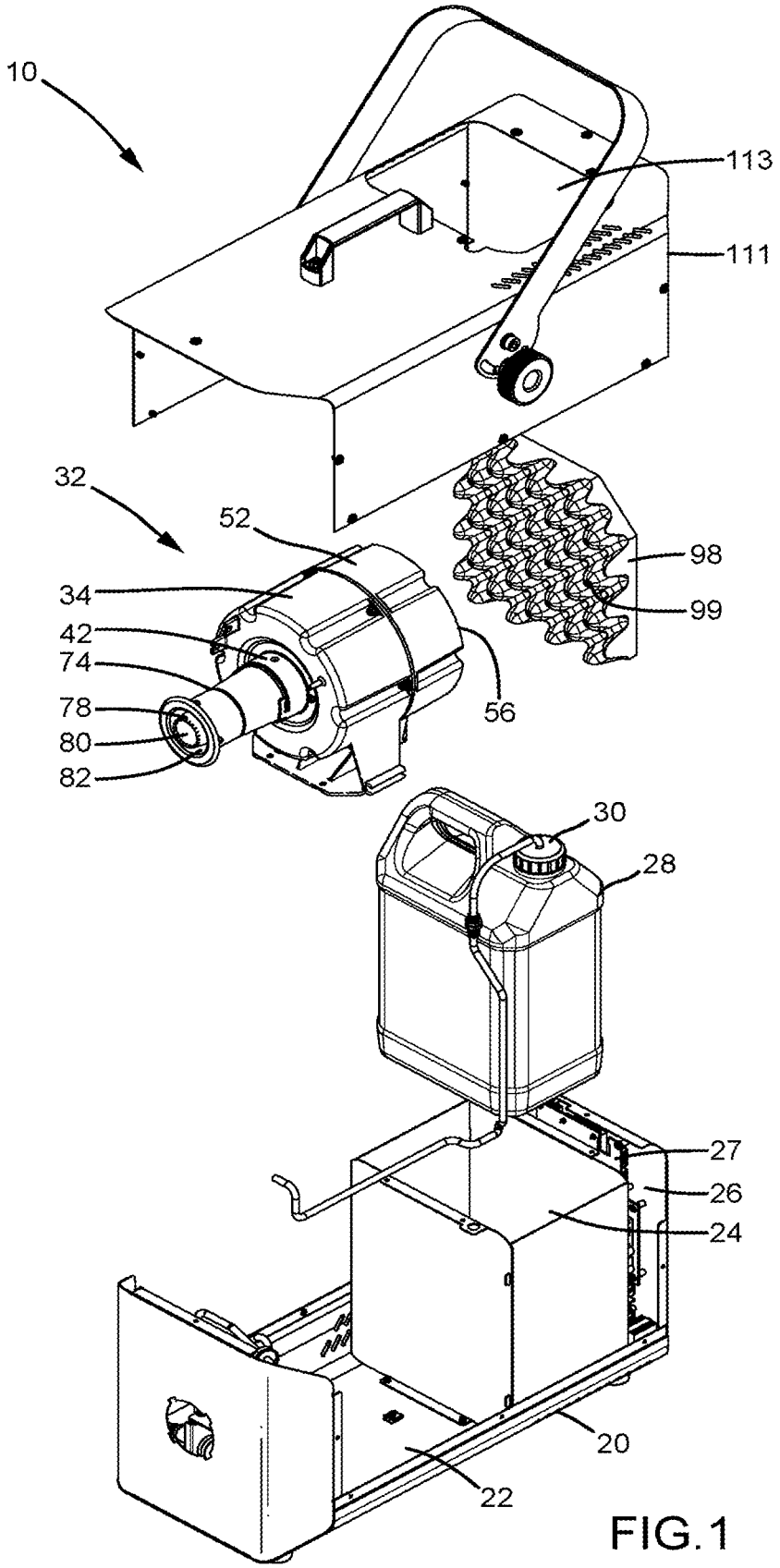
FIG. 1 is an exploded, perspective view of a snowflake machine of an embodiment according to the present invention.
Figure 2:
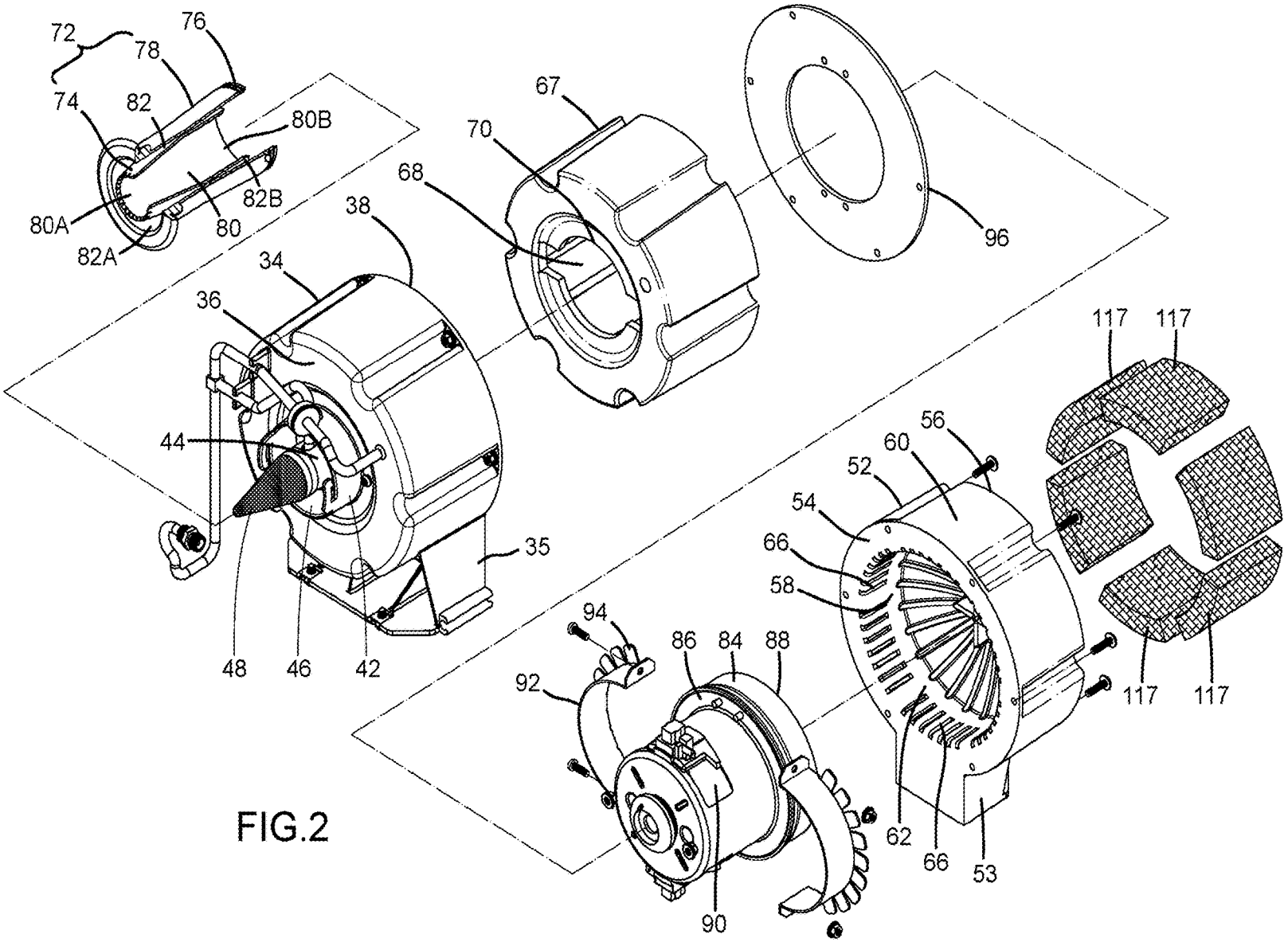
FIG. 2 is an exploded, perspective view of a blower module of the snowflake machine according to the present invention.
Figure 3A:
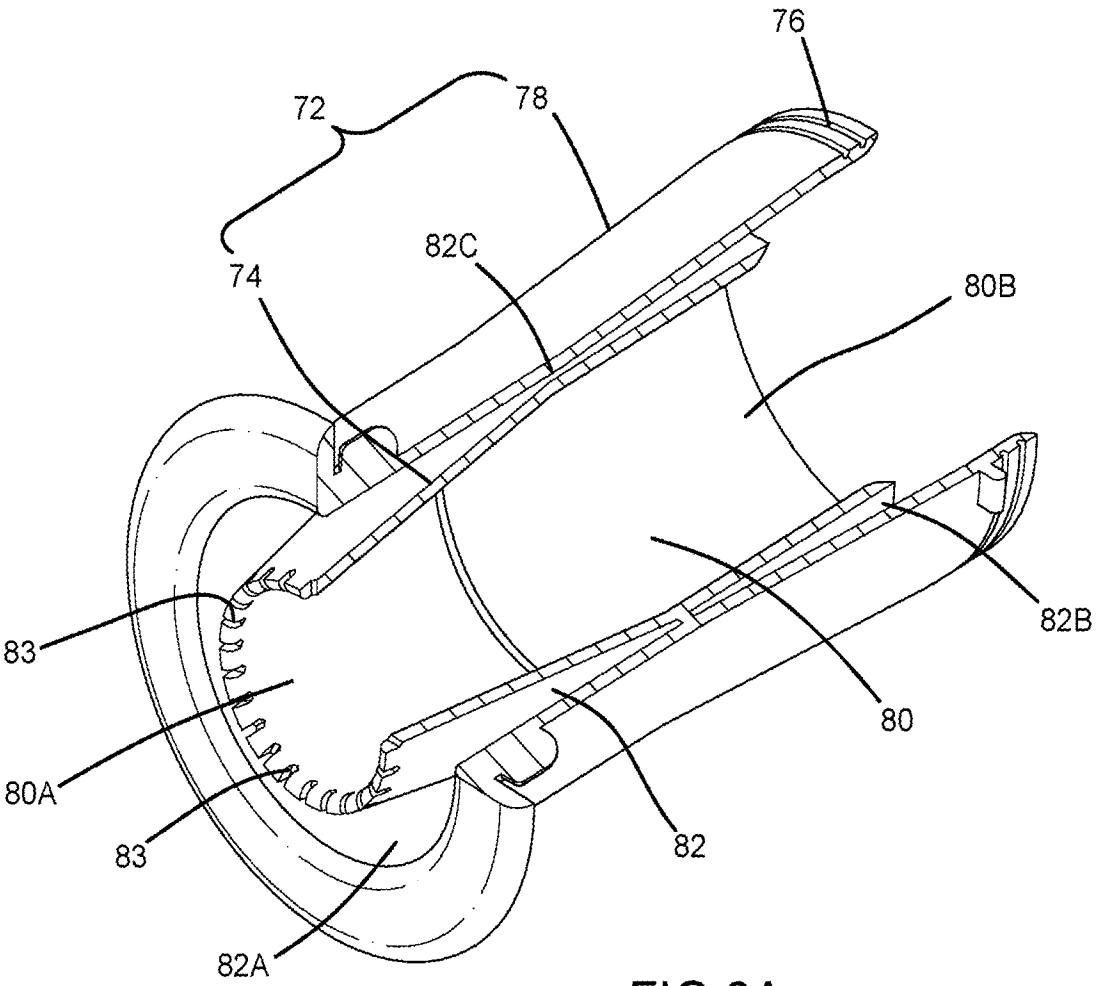
FIG. 3A is a partly-cutaway perspective view of an outlet device of the snowflake machine according to the present invention.
Figure 3B:
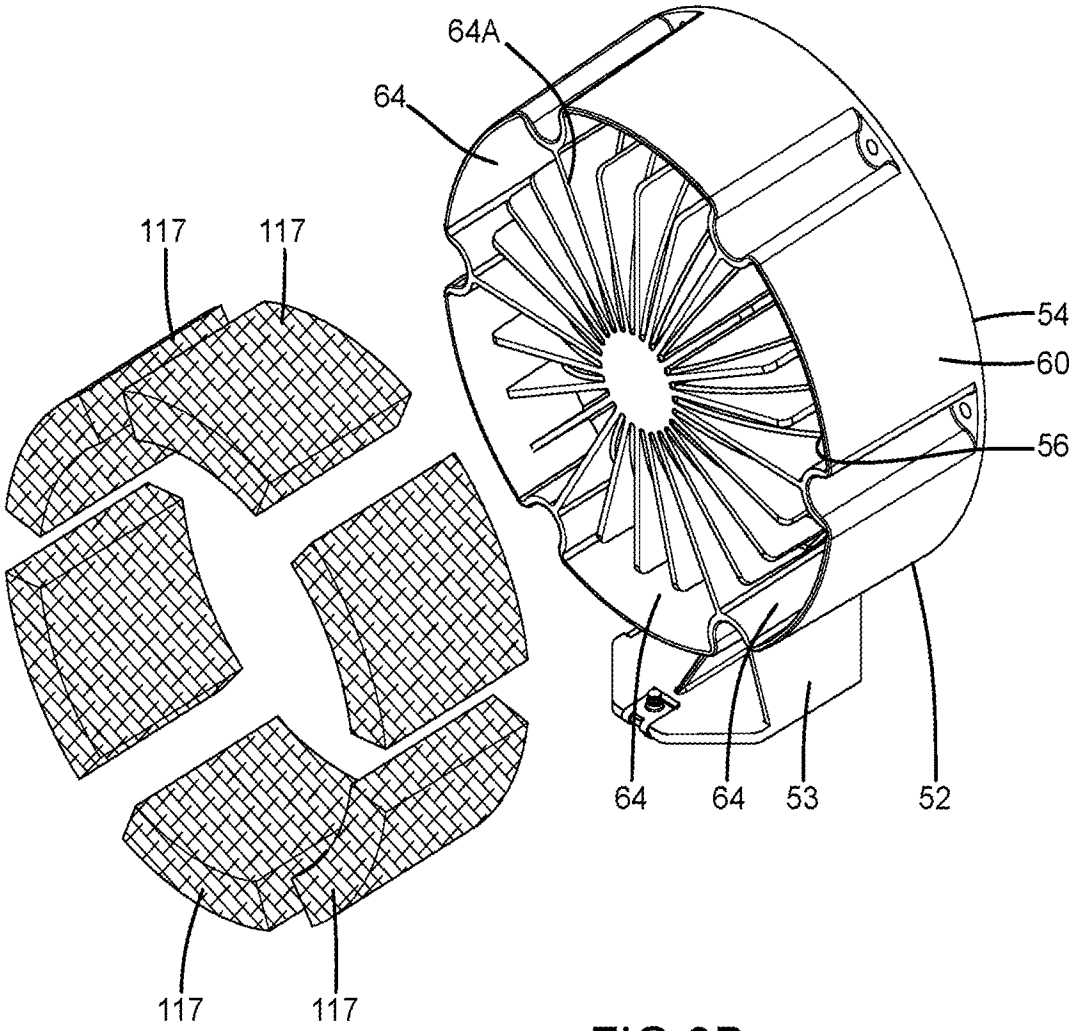
FIG. 3B is an exploded, perspective view of a second casing of the snowflake machine according to the present invention.
Figure 4:
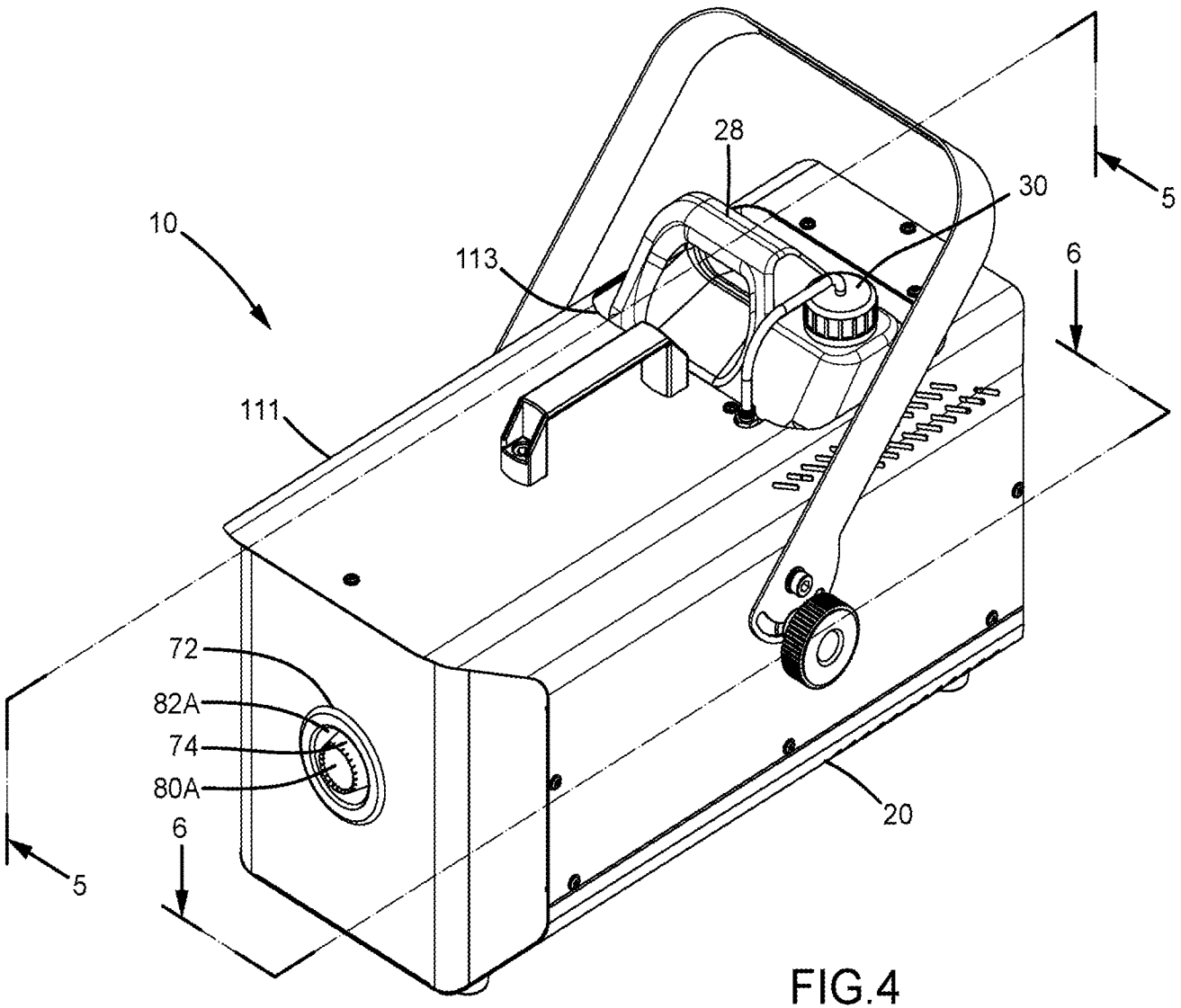
FIG. 4 is a perspective view of the snowflake machine according to the present invention after assembly.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "inner", "outer", "side", "end", "portion", "section", "axial", "lateral", "annular", "outward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

The present invention relates to a snowflake machine 10, particularly a snowflake machine 10 capable of generating tiny bubbles and blowing the snowflakes into the air to simulate the falling of snow. With reference to FIGS. 1-6, the snowflake machine 10 according to the present invention comprises a base 20 having a first space 22, a second space 24, and a third space 26. The second space 24 is located between the first space 22 and the third space 26.

Figure 5:
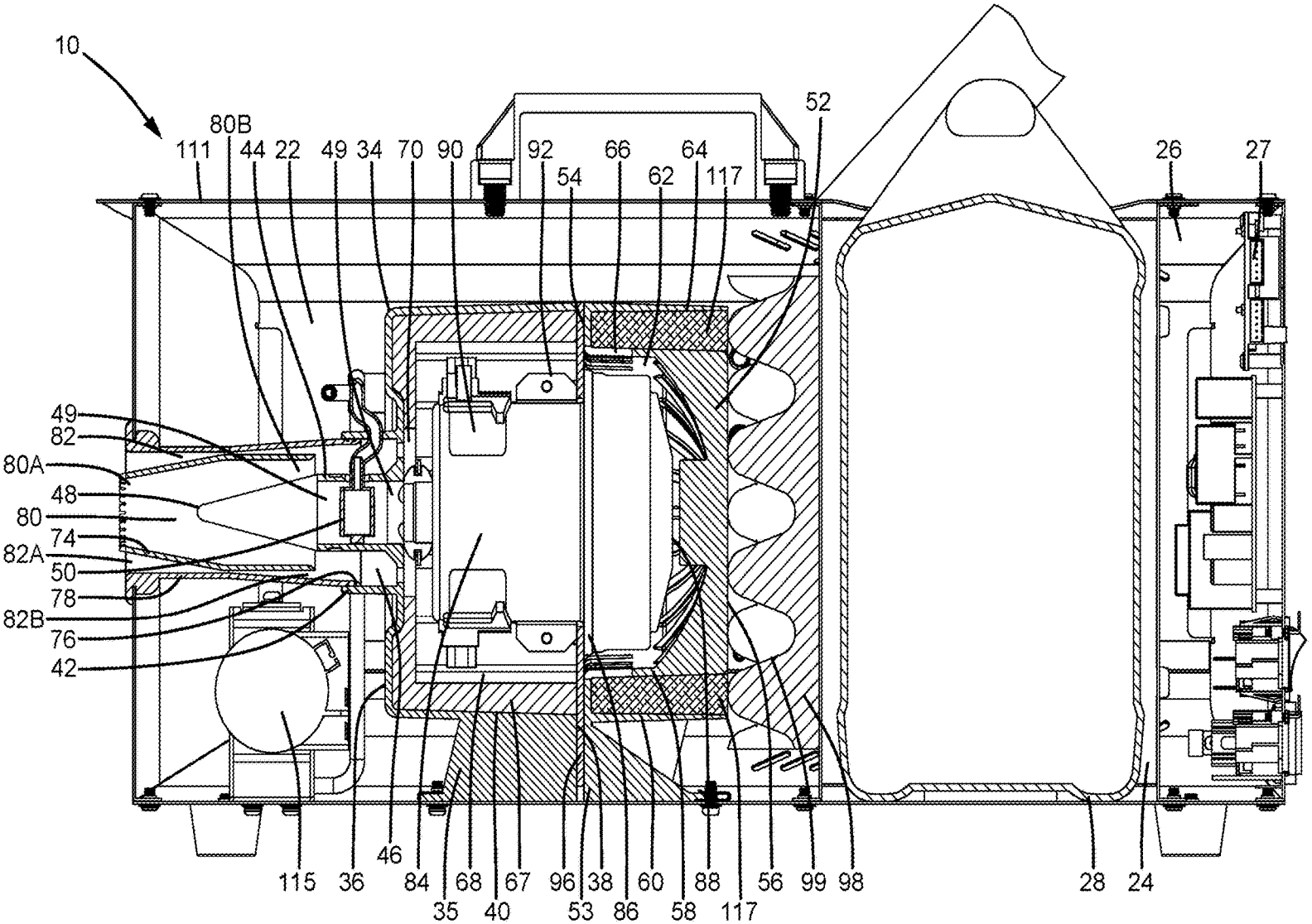
FIG. 5 is a cross sectional view taken along section line 5-5 of FIG. 4.
Figure 6:
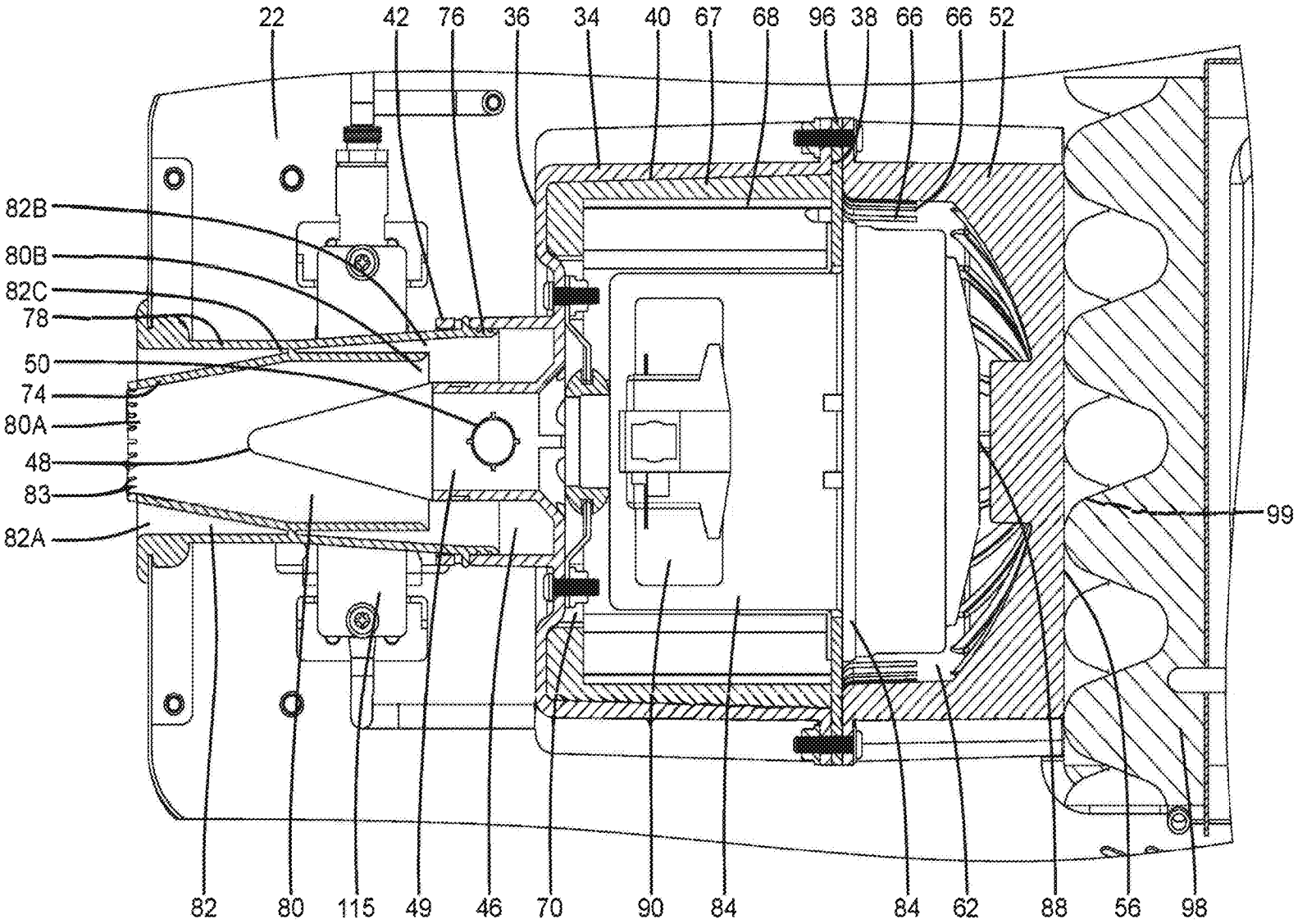
FIG. 6 is a cross sectional view taken along section line 6-6 of FIG. 4.

A pump 115 is securely disposed in the first space 22 of the base 20 (see FIG. 5). A storage tank 28 is received in the second space 24 and includes a cap 30 which can be opened through rotation. The storage tank 28 is used to store a known bubble liquid which may form tiny bubbles by air currents. Furthermore, an electrical control module 27 is received in the third space 26. The pump 115 is in electrical connection with the electrical control module 27. A pipeline can be disposed between the pump 115 and the storage tank 28, such that the bubble liquid stored in the storage tank 28 can be delivered when the pump 115 operates.

The snowflake machine 10 further comprises a blower module 32 securely disposed in the first space 22. The blower module 32 includes a first casing 34, a second casing 52, and a blower 84 disposed in the first casing 34 and the second casing 52 and in electrical connection with the electrical control module 27.

The first casing 34 includes a first side 36 and a second side 38 spaced from the first side 36 in a lateral direction. The first casing 34 further includes a chamber 40 extending from the second side 38 toward but spaced from the first side 36. The first casing 34 further includes an outer coupling portion 42 extending from the first side 36 away from the chamber 40 and an inner coupling portion 44. The outer coupling portion 42 is located around the inner coupling portion 44 which defines an inner air passageway 49 intercommunicating with the chamber 40. An outer air passageway 46 is defined between the inner coupling portion 44 and the outer coupling portion 42 and is located around the inner air passageway 49. The outer air passageway 46 intercommunicates with the chamber 40. The first casing 34 further includes a first supporting portion 35 formed on an outer periphery thereof. The first casing 34 is securely disposed on the base 20 via the first supporting portion 35.

The second casing 52 includes an inner side 54 and an outer side 56 spaced from the inner side 54 in the lateral direction. The second casing 52 further includes an outer peripheral wall 60 extending from the inner side 54 to the outer side 56. The second casing 52 further includes an inner peripheral wall 58 extending from the inner side 54 and spaced from the outer side 56. The inner peripheral wall 58 defines an inner space 62. The inner space 62 is open at the inner side 54. A plurality of partitioning boards 64A extends between the inner peripheral wall 58 and the outer peripheral wall 60 and separates the space between the inner peripheral wall 58 and the outer peripheral wall 60 into a plurality of outer spaces 64. The second casing 52 further includes a plurality of slots 66 formed on the inner peripheral wall 58 and intercommunicating with the inner space 62 and the plurality of outer spaces 64. Each of the plurality of slots 66 is adjacent to the inner side 54 and is spaced from the outer side 56. Furthermore, the second casing 52 further includes a second supporting portion 53 protruding outward from the outer peripheral wall 60.

A plurality of outer space mufflers 117 is respectively received in the plurality of the outer spaces 64 and respectively covers the plurality of slots 66 of the second casing 52. Each of the plurality of outer space mufflers 117 is made of a material permitting passage of air, such as air-permeable cotton fabric, such that air may pass through the gap in each of the plurality of outer space mufflers 117 and the respective slot 66 into the inner space 62. The sound resulting from passage of the air currents through the outer spaces 64 can be effectively absorbed by the plurality of outer space mufflers 117.

The second supporting portion 53 of the second casing 52 is screwed to the base 20. An annular shock-absorbing engaging member 96 (see FIGS. 2 and 4) is disposed between the inner side 54 of the second casing 52 and the second side 38 of the first casing 34 and may, but not limited to, be made of rubber.

The blower 84 includes an air inlet 88 and an air outlet 90 spaced from the air inlet 88. The blower 84 further includes a flange 86 formed between the air inlet 88 and the air outlet 90.

The lower 84 is received in the chamber 40 of the first casing 34 and the inner space 62 of the second casing 52. The shock-absorbing engaging member 96 is located around the blower 84 and has a side abutting the flange 86 of the blower 84. A set of clamping members 92 is securely disposed around the blower 84 and includes a plurality of wings 94 abutting another side of the shock-absorbing engaging member 96. Thus, the shock-absorbing engaging member 96 is securely sandwiched between the plurality of wings 94 of the clamping members 92 and the flange 86. The shock-absorbing engaging member 96 cooperates with the blower 84 to separate the chamber 40 from the inner space 62. The shock-absorbing engaging member 96 further supports positioning of the blower 84. The air outlet 90 of the blower 84 is located in the chamber 40. The air inlet 88 of the blower 84 is located in the inner space 62. The plurality of slots 66 of the second casing 52 is located between the air outlet 90 and the air inlet 88 of the blower 84 in the lateral direction.

When the blower 84 operates, the air inlet 84 generates a sucking force to make the air outside of the second casing 52 pass through the gaps of the plurality of outer space mufflers 117, the outer space 64, the plurality of slots 66, the inner space 62, and the air outlet 88 and finally exits the air outlet 90.

The snowflake machine 10 further comprises a bubble forming cap 48 and a bubble forming nozzle 50. The bubble forming cap 48 is disposed around a distal end of the inner coupling portion 44 and covers the inner air passageway 49. The bubble forming nozzle 50 is disposed in the inner air passageway 49 and is connected via a pipeline to the pump 115. The pump 115 is operated to deliver the bubble liquid stored in the storage tank 28 through the bubble forming nozzle 50 into the inner air passageway 49 and wets the bubble forming cap 48. The air currents generated by the blower 84 are guided by the inner air passageway 49 to pass through the bubble forming cap 48, such that the bubble liquid forms tiny bubbles (stimulating snowflakes) on the outer side of the bubble forming cap 48.

An inner muffler 67 is disposed in the chamber 40 of the first casing 34. An outer muffler 98 is disposed on the outer side of the second casing 52. The inner muffler 67 includes a receiving space 68 and a through-hole 70 extending from the receiving space 68. An outer surface of the inner muffler 67 abuts an inner surface of the chamber 50 of the first casing 34. The through-hole 70 is aligned with the inner air passageway 49 and the outer air passageway 46. The receiving space 68 overlaps with the chamber 40, such that both the inner air passageway 49 and the outer air passageway 46 intercommunicate with the receiving space 68. An end of the blower 84 where the air outlet 90 resides is received in the receiving space 68. The inner muffler 67 is used to reduce the sounds resulting from operation of the blower 84 and the air currents flowing out of the air outlet 90.

The outer muffler 98 includes a sinuous face 99 which abuts the outer side 56 of the second casing 52. The gaps between the outer side 56 and the sinuous face 99 permit air currents to enter the outer space 64. Furthermore, the outer muffler 98 is used to reduce the noises resulting from the sucking force generated by the blower 84 to cause flow of air.

The outer coupling portion 42 is coupled with an outlet device 72. The outlet device 72 includes a first portion 74 and a second portion 78 disposed around the first portion 74. The first portion 74 and the second portion 78 are connected by a plurality of ribs formed therebetween. The second portion 78 includes a coupling end 76. The first portion 74 defines a primary passageway 80. The primary passageway 80 includes a first end 80A and a second end 80B spaced from the first end 80A in the lateral direction. A secondary passageway 82 is formed between the first portion 74 and the second portion 78. The secondary passageway 82 includes an outlet end 82A aligned with the first end 80A in the lateral direction, an inlet end 82B, and an intermediate portion 82C between the outlet end 82A and the inlet end 82B. Furthermore, the second end 80B and the inlet end 82B are located between the coupling end 76 and the first end 80A in the axial direction (lateral direction) of the primary passageway 80.

The cross sectional area of the first end 80A of the primary passageway 80 is smaller than the cross sectional area of the second end 80B. The cross sectional area of the inlet end 82B is smaller than the cross sectional area of the outlet end 82A. The cross sectional area of the intermediate portion 82C is smaller than the cross sectional area of the inlet end 82B. The cross sectional area of the first end 80A is smaller than the cross sectional area of the outlet end 82A. Thus, air currents accelerate when flowing from the inlet end 82B to the intermediate portion 82C. The accelerated air currents decelerate when flowing from the intermediate portion 82C to the outlet end 82A. Therefore, the high-frequency noises resulting from the air currents flowing through the secondary passageway 82 are reduced. Furthermore, the first portion 74 includes a plurality of cutouts 83 formed on the first end 80A. Each of the plurality of cutouts 83 intercommunicates with the first end 80A of the primary passageway 80 and the outlet end 82A of the secondary passageway 82.

The coupling end 76 of the outlet member 72 is coupled with the outer coupling portion 42 of the first casing 34. Both the primary passageway 80 and the secondary passageway 82 intercommunicate with the outer air passageway 46. The bubble forming cap 48 is located in the primary passageway 80 and is spaced from the first end 80A.

It is worth mentioning that since the cross sectional area of the outlet end 82A is greater than the cross sectional area of the first end 80A, the velocity of the air currents (blown out of the blower 84) passing through the first end 80A will be higher than the velocity of the air currents passing through the outlet end 82A, such that the pressure of the air currents at the first end 80A is smaller than the pressure of the air currents at the outlet end 82A according to Bernoulli's principle.

The snowflake machine 10 further comprises an outer casing 111 having an opening 113. The outer casing 11 is fixed to the outer side of the base 20. The cap 30 of the storage tank 28 is exposed via the opening 113. The blower module 32 and the electrical control module 27 are located inside the outer casing 111.

When the snowflake machine 10 operates, the pump 115 delivers the bubble liquid stored in the storage tank 28 toward the bubble forming nozzle 50 and wet the bubble forming cap 48. The blower 84 operates to generate a sucking force at the air inlet 88, such that the air outside of the second casing 52 passes through the outer space 64 and each of the plurality of slots 66 into the inner space 62. The air currents flowing out of the air outlet 90 further pass through the bubble forming cap 48 wetted by the bubble liquid, thereby forming tiny bubbles. The air currents flowing out of the air outlet 90 pass through the primary passageway 80 to push the tiny bubbles upward into the sky in a direction toward the first end 80A (the outlet). Therefore, the tiny bubbles drift down to simulate snowfall.

The air currents flowing out of the primary passageway 80 push the bubbles away from the snowflake machine 10, and the air currents flowing out of the secondary passageway 82 are around the bubbles. Thus, the air currents from the secondary passageway 82 can maintain the bubbles within a certain distance in the air. As a result, the bubbles pushed into the air will not disperse and fall in a place near the snowflake machine 10. Accordingly, the bubbles simulating snowfall can be pushed to a place farther from the snowflake machine 10.

By the provision of the plurality of cutouts 83, the primary passageway 80 and the secondary passageway 82 can intercommunicate with each other, such that the air currents from the primary passageway 80 and the air currents from the secondary passageway 82 interact with each other. Thus, the bubbles are less likely to accumulate on the outlet device 72.

The cross sectional area of the first end 80A is smaller than that of the outlet end 82A, such that the pressure of the air currents flowing through the first end 80A is smaller than that of the pressure of the air currents flowing through the outlet end 82A. As a result, a sucking force can be generated at the first end 80A relative to the outlet end 82A. Thus, the bubbles accumulated at the first end 80A of the outlet device 72 can be easily pushed toward the primary passageway 80 due to the pressure difference and subsequently pushed into the air by the air currents from the primary passageway 80. Accordingly, water dripping at the outlet device 72 resulting from accumulation of bubbles is less likely to occur.

The inner muffler 67 is used to absorb sounds resulting from operation of the blower 84 and the outputted air currents. The outer muffler 98 is used to effectively absorb the sounds resulting from the air currents sucked into the blower 84 and operation of the blower 84, such that the overall noise value caused by the operation of the whole snowflake machine 10 is further reduced.

By the disposition of the outer space 64 and the inner space 62 of the second casing 52, the sound resulting from the airflow during the air-sucking operation of the blower 84 can be reduced.

The plurality of outer space mufflers 117 covers the plurality of slots 66, such that when the blower 84 operates to suck in air, the air must pass through the gap of each of the plurality of outer space mufflers 117 before passing through the respective slot 66. Thus, when the air passes through the plurality of outer space mufflers 117, the sound resulting from the airflow can be effectively absorbed by the plurality of outer space mufflers 117.

Now that the basic teachings of the present invention have been explained, many extensions and variations will be obvious to one having ordinary skill in the art. For example, the blower module 32 does not have to include the inner muffler 67 and the outer muffler 98. In this case, the bubbles can still be pushed out of the outlet device 72 to a position farther from the snowflake machine 10, thereby simulating snowfall. Furthermore, the second casing 52 does not have to include partitioning boards 64A. Instead, the second casing 52 includes a single annular outer space 64, whereas the plurality of outer space mufflers 117 can be replaced by a single annular muffler.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A snowflake machine comprising:

a base;

a blower module fixed in the base and including a blower having an air outlet, wherein the blower module includes an inner coupling portion and an outer coupling portion located around the inner coupling portion, wherein the inner coupling portion defines an inner air passageway therein, wherein an outer air passageway is defined between the inner coupling portion and the outer coupling portion and is located around the inner air passageway;

an outlet device connected to the outer coupling portion, wherein the outlet device includes a primary passageway and a secondary passageway spaced from the primary passageway, wherein the primary passageway is located between the inner air passageway and the secondary passageway in a radial direction of the inner air passageway, wherein the inner air passageway is located between the primary passageway and the blower in a longitudinal direction of the inner air passageway, and wherein each of the primary passageway and the secondary passageway intercommunicates with the outer air passageway;

a bubble forming cap coupled with the inner coupling portion and spaced from the primary passageway and the secondary passageway;

a storage tank securely disposed in the base and configured to store a bubble liquid; and a pump securely disposed in the base, wherein the pump delivers the bubble liquid to the bubble forming cap, wherein the blower operates to generate air currents which enter the inner air passageway to cause the bubble forming cap to generate bubbles, wherein the air currents also enter the outer air passageway to pass through the primary passageway and the secondary passageway and move to an outer side of the outlet device, such that a portion of the air currents passes through the primary passageway and pushes the bubbles generated by the bubble forming cap outward, and wherein another portion of the air currents passes through the secondary passageway to prevent the bubbles and the bubble liquid from accumulating in an outlet of the primary passageway and surrounds the bubbles, thereby pushing the bubbles farther away from the outlet device.

2. The snowflake machine as claimed in claim 1, wherein the outlet device further includes a first portion and a second portion disposed around the first portion, wherein the second portion includes a coupling end coupled with the outer coupling portion, wherein the primary passageway is inside the first portion, wherein the secondary passageway is formed between the first portion and the second portion, wherein a length of the primary passageway in the longitudinal direction of the inner air passageway is substantially equal to a length of the secondary passageway in the longitudinal direction of the inner air passageway, wherein the primary passageway includes a first end permitting ejection of the air currents and the bubbles and a second end permitting entrance of the air currents, wherein the secondary passageway includes an outlet end aligned with the first end of the primary passageway, wherein the second end of the primary passageway and an inlet end of the secondary passageway are located between the coupling end of the second portion and the first end of the primary passageway in the longitudinal direction of the inner air passageway and is spaced from the coupling end and the inner air passageway, wherein the first portion further includes a plurality of cutouts adjacent to the first end of the primary passageway and spaced from the second end of the primary passageway, wherein each of the plurality of cutouts extends beyond the secondary passageway in the longitudinal direction, and wherein each of the plurality of cutouts intercommunicates with the first end of the primary passageway and the outlet end of the secondary passageway, thereby preventing the bubbles and the bubble liquid from accumulating in the first end of the primary passageway.

3. The snowflake machine as claimed in claim 1, wherein the primary passageway includes a first end remote from the blower and a second end adjacent to the blower, wherein the secondary passageway includes an outlet end adjacent to the first end of the primary passageway and an inlet end adjacent to the second end of the primary passageway, wherein a cross sectional area of the outlet end is greater than a cross sectional area of the first end, such that a velocity of air currents flowing through the outlet end is smaller than a velocity of air currents flowing through the first end.

4. A snowflake machine comprising:

a base;

a blower fixed in the base and including an air outlet;

an outlet device connected to the blower, wherein the outlet device includes a primary passageway and a secondary passageway spaced from the primary passageway, and wherein each of the primary passageway and the secondary passageway intercommunicates with the air outlet of the blower;

a bubble forming cap disposed in the primary passageway and intercommunicating with the air outlet;

a storage tank securely disposed in the base and configured to store a bubble liquid; and a pump securely disposed in the base, wherein the pump delivers the bubble liquid to the bubble forming cap, wherein the blower operates to generate air currents to cause the bubble forming cap to generate bubbles, wherein the air currents generated by the blower pass through the primary passageway and the secondary passageway and move to an outer side of the outlet device, thereby pushing the bubbles generated by the bubble forming cap outward, and wherein the air currents pass through the secondary passageway to prevent the bubbles and the bubble liquid from accumulating in an outlet of the primary passageway and to push the bubbles farther away from the outlet device, wherein the primary passageway includes a first end remote from the blower and a second end adjacent to the blower, wherein the secondary passageway includes an outlet end adjacent to the first end of the primary passageway and an inlet end adjacent to the second end of the primary passageway, wherein a cross sectional area of the outlet end is greater than a cross sectional area of the first end, such that a velocity of air currents flowing through the outlet end is smaller than a velocity of air currents flowing through the first end, wherein the cross sectional area of the first end of the primary passageway is smaller than a cross sectional area of the second end of the primary passageway, wherein a cross sectional area of the inlet end is smaller than a cross sectional area of the outlet end, wherein the secondary passageway further includes an intermediate portion between the outlet end and the inlet end, and wherein a cross sectional area of the intermediate portion is smaller than the cross sectional area of the inlet end, such that high-frequency noises generated by the air currents flowing through the secondary passageway is reduced.

5. The snowflake machine as claimed in claim 1, further comprising:

a first casing including a chamber intercommunicating with the inner air passageway and the outer air passageway; and a second casing coupled with the first casing, wherein the second casing includes an inner space and a plurality of slots intercommunicating the inner space with an outer side of the second casing, wherein the inner spaced is spaced from the chamber, wherein the blower is received in the chamber and the inner space, wherein the blower includes an air inlet located in the inner space, wherein the air outlet of the blower is located in the chamber, and wherein each of the plurality of slots is located between the air inlet and the air outlet in a lateral direction.

6. The snowflake machine as claimed in claim 5, further comprising:

an inner muffler securely disposed in the chamber of the first casing and spacedly disposed around the air outlet, wherein the inner muffler is configured to reduce sounds resulting from operation of the blower and flow of the air currents; and an outer muffler, wherein the second casing further includes an inner peripheral wall and an outer peripheral wall spaced from and around the inner peripheral wall, wherein the inner space is defined by the inner peripheral wall, wherein an outer space is defined between the inner peripheral wall and the outer peripheral wall, wherein the outer space extends to an outer side of the second casing, wherein the plurality of slots is formed on the inner peripheral wall and intercommunicates with the inner space and the outer space, and wherein the outer muffler abuts the outer side of the second casing and is configured to reduce sound resulting from operation of the blower for sucking in air.

7. A snowflake machine comprising:

a base;

a first casing securely disposed on the base, wherein the first casing includes a chamber, an inner air passageway intercommunicating with the chamber, and an outer air passageway located around the inner air passageway and intercommunicating with the chamber;

a second casing securely disposed on the base, wherein the second casing includes an outer side and an inner side, wherein the second casing further includes an inner space extending from the inner side toward but spaced from the outer side, wherein the second casing further includes a plurality of slots intercommunicating with the inner space, and wherein the inner side of the second casing is sealingly coupled with the first casing;

a blower securely disposed between the first casing and the second casing, wherein the blower includes an air inlet located in the inner space and an air outlet located in the chamber;

an inner muffler securely disposed in the chamber and spaced from the blower, wherein the inner muffler reduces sound resulting from operation of the blower and air currents flowing out of the air outlet;

an outer muffler permitting passage of air and abutting the outer side of the second casing, wherein the outer muffler reduces sound resulting from the air currents sucked into the air inlet of the blower;

a bubble forming cap coupled with the inner air passageway of the first casing;

an outlet device coupled with the outer air passageway of the first casing, wherein the outlet device includes a primary passageway intercommunicating with the outer air passageway, and wherein the bubble forming cap is located in the primary passageway;

a storage tank securely disposed in the base and configured to store a bubble liquid; and a pump securely disposed in the base, wherein the pump delivers the bubble liquid to the bubble forming cap, wherein the blower operates to generate air currents to cause the bubble forming cap to generate bubbles, wherein the air currents generated by the blower further pass through the primary passageway and move to an outer side of the outlet device, thereby pushing the bubbles generated by the bubble forming cap outward.

8. The snowflake machine as claimed in claim 7, wherein the second casing further includes an inner peripheral wall extending to the inner side and an outer peripheral wall spaced from and around the inner peripheral wall, wherein the inner space is defined by the inner peripheral wall, wherein an outer space is defined between the inner peripheral wall and the outer peripheral wall, wherein the outer space extends to the outer side of the second casing, wherein the plurality of slots is formed on the inner peripheral wall and intercommunicates with the inner space and the outer space, and wherein the outer muffler is configured to permit air currents to flow into and cover the inner space.

9. The snowflake machine as claimed in claim 8, wherein the outer muffler further includes a sinuous face abutting the outer side of the second casing, and wherein the outer side and the sinuous face have gaps therebetween to permit entrance of the air currents into the outer space.

10. The snowflake machine as claimed in claim 7, wherein the outlet device further includes a first portion and a second portion disposed around the first portion, wherein the primary passageway is inside the first portion, wherein the secondary passageway is formed between the first portion and the second portion, wherein the first portion further includes a plurality of cutouts formed at an outlet of the primary passageway, and wherein each of the plurality of cutouts intercommunicates with the primary passageway and the secondary passageway.

11. The snowflake machine as claimed in claim 10, wherein the primary passageway includes a first end remote from the air outlet of the blower and a second end adjacent to the air outlet of the blower, wherein the secondary passageway includes an outlet end adjacent to the first end of the primary passageway and an inlet end adjacent to the second end of the primary passageway, and wherein a cross sectional area of the first end is smaller than a cross sectional area of the outlet end, such that a velocity of air currents flowing through the first end is greater than a velocity of air currents flowing through the outlet end.

12. The snowflake machine as claimed in claim 7, further comprising a plurality of outer space mufflers permitting passage of air currents, wherein the second casing further includes an inner peripheral wall extending to the inner side and an outer peripheral wall spaced from and around the inner peripheral wall, wherein the inner space is defined by the inner peripheral wall, wherein a plurality of partitioning boards is interconnected between the inner peripheral wall and the outer peripheral wall to define a plurality of outer spaces between the inner peripheral wall and the outer peripheral wall, wherein each of the plurality of outer spaces extends to the outer side of the second casing, wherein the plurality of slots is formed on the inner peripheral wall and intercommunicates with the inner space and each of the plurality of outer spaces, wherein each of the plurality of outer space mufflers is received in a respective one of the plurality of outer spaces, wherein each of the plurality of outer space mufflers covers a respective one of the plurality of slots and is configured to absorb sound resulting from the air currents passing therethrough, and wherein the outer muffler is configured to permit the air currents to flow into and cover the inner space.

* * * * *